United States Patent [19]

Serruys

[11] 4,256,066

[45] Mar. 17, 1981

[54] CARBURETTOR

[75] Inventor: Max Y. A. M. Serruys, 123/545, France

[73] Assignee: Agence Nationale de Valorisation de la Recherche (ANVAR), Neuilly sur Seine, France

[21] Appl. No.: 55,747

[22] Filed: Jul. 6, 1979

Related U.S. Application Data

[63] Continuation of Ser. No. 640,923, Dec. 15, 1975, abandoned.

[30] Foreign Application Priority Data

Dec. 27, 1974 [FR] France ..... 74 42953

[51] Int. Cl.[3] ..... F02M 31/00

[52] U.S. Cl. ..... 123/545; 261/144; 261/145

[58] Field of Search ..... 123/122 A, 141; 48/180 R, 180 H; 165/51, 52; 261/144, 145, 50 A

[56] References Cited

U.S. PATENT DOCUMENTS

| | | | |
|---|---|---|---|
| 1,245,519 | 11/1917 | Smith | 123/122 A |
| 1,795,037 | 3/1931 | Portail | 123/122 A |
| 3,444,848 | 5/1969 | Lawrence | 261/145 |
| 3,752,451 | 8/1973 | Kendig | 261/50 A |
| 3,796,413 | 3/1974 | Woods | 261/50 A |
| 3,920,778 | 11/1950 | Rugeris | 261/50 A |
| 3,930,478 | 1/1976 | Brettschneider | 123/122 A |

FOREIGN PATENT DOCUMENTS

| | | | |
|---|---|---|---|
| 2243914 | 3/1974 | Fed. Rep. of Germany | 123/122 A |
| 1110524 | 2/1956 | France | 123/122 A |

*Primary Examiner*—Ronald H. Lazarus
*Attorney, Agent, or Firm*—Young & Thompson

[57] ABSTRACT

The invention relates to a carburettor comprising a conduit with an air-intake and a fuel-introduction device in this conduit, the latter being intended to supply a carburetted fuel mixture to at least one combustion chamber of an explosion engine, and a throttle-valve means mounted in the conduit for controlling the supply flow-rate of carburetted mixture to the combustion chamber, the conduit further comprising a device with surfaces distributed over the transverse section of the conduit, this device being located in the conduit between the fuel-introduction device and the throttle-valve and providing a means of complete or almost complete vaporization of the fuel, thus avoiding inequalities of distribution of the richness of the mixture over the transverse section of the conduit, on the downstream side of the throttle-valve. The surfaces device may comprise a plurality of corrugated fins mounted in a rectilinear portion of the conduit or it may comprise a plurality of incurved fins mounted in an elbow of the conduit, or again the surfaces device consists of a nest of transverse tubes in mutually staggered relation. The throttle-valve means preferably comprises two symmetrical conjointly-operated shutters pivotally mounted on shafts transversely to the conduit.

1 Claim, 7 Drawing Figures

CARBURETTOR

This is a continuation of application Ser. No. 640,923, filed Dec. 15, 1975, and now abandoned.

The present invention relates to a carburettor, especially for the explosion engine of an automobile vehicle and other applications, comprising a conduit having an airintake, a fuel-introduction device in the said conduit, said conduit being adapted to supply a carburetted mixture to at least one combustion chamber of the engine, and a butterfly throttle device in the said conduit, generally actuated by an accelerator, for controlling the supply flow of carburetted mixture to the said chamber and in consequence the power of the engine.

If is known that, in the immense majority of usual carburettors, the introduction device by which the fuel is discharged so as to be mixed with air, either in the liquid state or in an emulsion state, is located at the neck of a Venturi, and that it is on the downstream side of this latter that there is arranged the butterfly throttle device for the gases, actuated by the accelerator.

It is also known that the result of this arrangement is that a large proportion of the fuel which has been sprayed into the flow of air, the flow-rate of which is controlled by the said butterfly valve, becomes projected and distributed on the surface of this butterfly, so that for an opening which is not zero and not full, this fuel has a tendency to flow in a layer over the surface of the said butterfly, and in consequence to be thrown-off on a certain side of the supply channel of carburetted gases to the engine, with a consequent substantial inequality in richness between the streams of gas which circulate downstream of the butterfly throttle-valve of the gases on one side and the other inside the pipe.

It is in order to try to reduce the consequences of this inequality of distribution of the richness in fuel in the stream of gas and the corresponding defect in uniformity, that it has already been proposed to replace the butterfly-valve having an axis perpendicular to the direction of the admission conduits of explosion motors with cylinders arranged in line, by butterfly valves with an axis parallel to the said admission conduit.

On the other hand, it has been proposed, for example in French Pat. No. 986,897 applied for on Mar. 25, 1949 by Mr. Max Yves Antonin SERRUYS for "Improvements in carburation by carburettors", and in French Pat. No. 1,110,524 applied for on Sept. 10, 1954 by Mr. Max Yves Antonin SERRUYS for "Economiser for explosion engine with a carburettor", to arrange on the downstream side of the butterfly throttle-valve, surfaces equally distributed over the whole section of the stream of gas which passes out of the carburettor, and having a shape or arrangement suitable for drying-off the less fine droplets of fuel on the said surfaces, with the object of producing the vaporization of the greater part of the fuel before its admission to the engine and in any case of all the fuel which has not been atomized to an extremely fine degree.

The present invention has for its object a carburettor which provides a greatly improved uniformity of the carburetted mixture as compared with that which it has been possible to obtain up to the present time, with a perfectly uniform distribution of the richness in the various cylinders of the engine and also throughout the same cylinder, this being combined with very simple construction and excellent performance in operation and consumption.

According to the invention, a carburettor having a conduit comprising a device with surfaces distributed in the transverse section of the said conduit, is essentially characterized in that the said device with surfaces is located in the said conduit between the fuel-injection device and the butterfly throttle-valve, that is to say upstream of this latter.

These surfaces are arranged so as to have a sufficient temperature, for example 30° C. or higher, in order that the droplets of fuel become fairly effectively vaporized there, so that they are not liable to form along the downstream edges of the said surfaces, drops capable of being carried away with the gases.

By virtue of this arrangement according to the invention, the greater part if not the whole of the fuel is vaporized without modifying the distribution of this fuel in the transverse section of the stream of gas (and in consequence under optimum conditions of symmetry and uniformity) before the flow of gas reaches the butterfly throttle-valve.

The mixture being thus totally or almost totally vaporized, the presence of the butterfly-valve can no longer modify substantially the distribution of the richness in the transverse section of the admission conduit, since in a mixture which is already homogeneous, the drying-off and inertia effects which could have a bad effect on this distribution are thereby radically eliminated.

In one form of construction, the device with surfaces is placed in a rectilinear portion of the conduit and comprises a series of corrugated fins, whereas in an alternative form it is placed in an elbow of the conduit and comprises a series of incurved fins. In another alternative, the surfaces device comprises a nest of tubes in staggered relation, mounted either in a straight portion or in an elbow of the conduit.

According to another characteristic feature, the butterfly throttle-valve comprises two shutters pivotally mounted respectively on two axes transversely to the said conduit, and a control for rotating the said shutters in synchronism in a symmetrical manner, the axis of each shutter extending preferably along a line substantially central to the latter, passing approximately through the barycentre in such manner that the shutter is substantially balanced.

It should be noted that the fact of utilizing simultaneously, on the one hand the surfaces intended to cause the vaporization of the fuel, interposed between the introduction device and throttle device for the gases and, on the other hand, a throttle device of this kind formed by two symmetrical shutters having symmetrical inclinations at every moment, permits a considerable improvement in the homogeneity of the carburetted mixture, both on a small scale (micro-structure) and on a large scale (macro-structure).

These two aspects of homogeneity are both essential to irreproachable operation. The surfaces act more particularly on the micro-structure while the means described above act more particularly on the macro-structure, both by the choice of the position of the surfaces on the upstream side of the butterfly-valve and by the construction of the butterfly-valve in the form of two symmetrical shutters.

The present invention has also for its object a carburettor characterized by the inherent construction of its butterfly throttle-valve which comprises two shutters pivotally mounted respectively along two axes transversely to the said conduit, the axis of each shutter extending along a substantially central line of this latter, passing approximately through the barycentre in such manner that the shutter is substantially balanced, and a control for causing the said shutters to rotate in synchronism in a symmetrical manner.

As previously indicated, this carburettor may advantageously comprise surfaces disposed on the upstream side of the butterfly valve with two shutters, but if necessary, and depending on the cases of utilization, it could either comprise such surfaces on the downstream side of the butterfly valve, or it may even dispense with these surfaces.

Some forms of embodiment of the invention are described below by way of example, reference being made to the accompanying drawings, in which.

Figure 7:
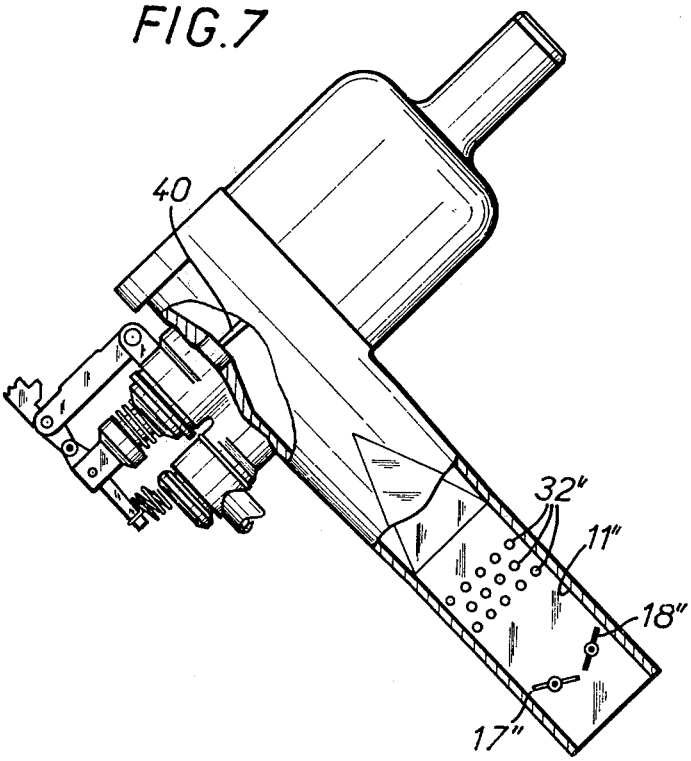

FIG. 7 relates to another alternative form of carburettor, in which the surfaces are constituted by a nest of tubes.

Figure 1:
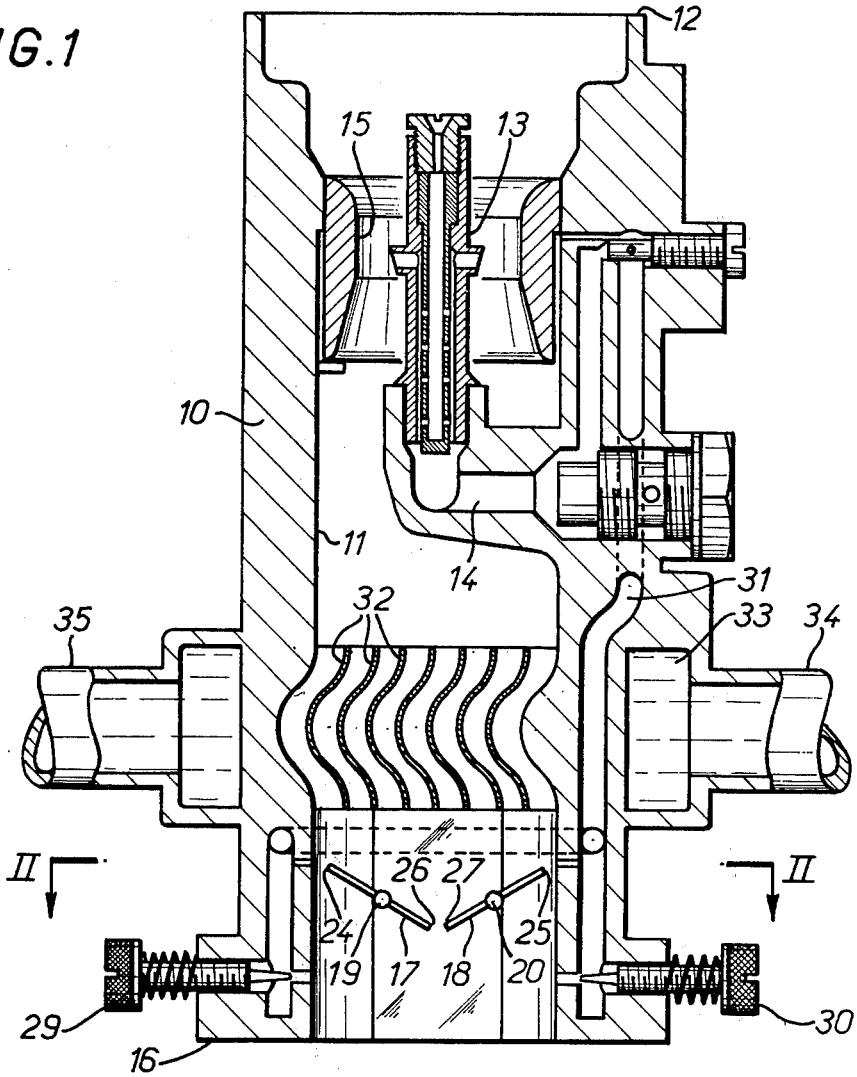
FIG. 1 is a view of a carburettor according to the invention, in longitudinal cross-section, taken along the line I—I of FIG. 2, in which the surfaces are disposed on the upstream side of the two-shutter butterfly-valve, and consist of corrugated fins.
Figure 2:
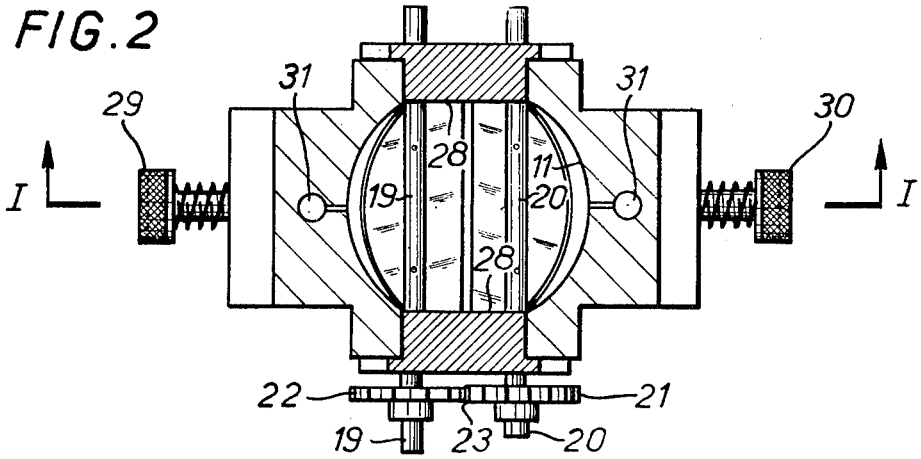
FIG. 2 is a corresponding view in transverse section, taken along the line II—II of FIG. 1.
Figure 3:
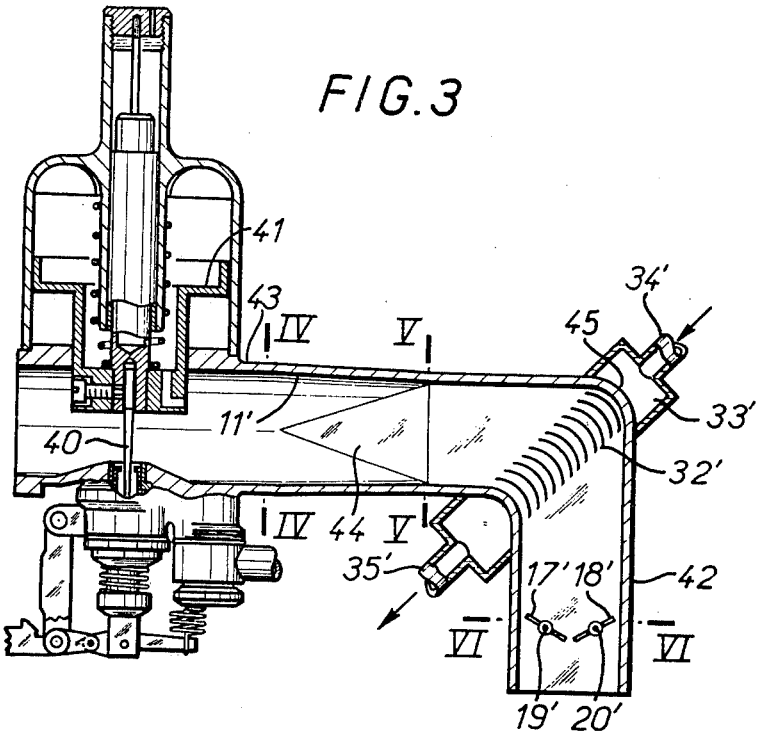
FIG. 3 is a view in longitudinal section of an alternative form of carburettor, in which the surfaces are incurved fins, mounted in an elbow of the conduit.

Reference will first be made to FIGS. 1 and 2 which relate, by way of example, to a carburettor for an internal combustion engine of an automobile vehicle.

The carburetor comprises an external wall 10 which defines a conduit 11. The conduit 11 is rectilinear in the example shown. It comprises an air intake 12 and a fuel-introduction device 13 supplied with petrol at 14. The fuel-injection device 13 is arranged at the level of a Venturi 15 provided in the conduit 11.

The outlet 16 of the conduit 11 is intended to be coupled to an admission pipe of the engine in order to supply the combustion chamber or chambers of the engine with carburetted mixture.

The conduit 11 comprises a butterfly throttle device 17, 18, intended to control the flow-rate of supply of the combustion chamber with carburetted mixture and actuated under the control of the accelerator pedal of the automobile vehicle.

The butterfly throttle device 17, 18 is constituted by two shutters 17 and 18 rotatably mounted respectively along two shafts 19 and 20 transverse to the rectilinear conduit 10 and each extending at right angles to the axis of this conduit along a substantially central line of the corresponding shutter passing approximately through the barycentre or centre of gravity, in such manner that the shutters are substantially balanced.

The control provided for driving the shutters 17 and 18 in rotation about the shafts 19 and 20 is such that the shafts 19 and 20 are subjected to rotations which are approximately equal, the shutters 17 and 18 constantly occupying symmetrical positions with respect to a plane parallel to the shafts 19 and 20 and passing through the axis of the conduit 11 in the region of the shutters 17 and 18.

In the example shown, the axes 19 and 20 are rigidly fixed respectively to pinions 21 and 22 which engage at 23 in such manner that by turning the shaft 19, the two shutters 17 and 18 are pivoted in a symmetrical manner. It will be understood that the control of the shutters 17 and 18 could comprise any other appropriate means equivalent to the hears 21, 22.

In order that the symmetrical shutters 17 and 18 may perfectly close the conduit 11, it is provided, on the one hand that in the closed position, the edges 24, 25 of the shutters 17 and 18 rotated towards the conduit 11 can come into contact with this latter over the whole of the corresponding length, for example along an elliptical contour, and that, precisely at the moment when the internal edges 26 and 27 of the two shutters 17 and 18 are applied one on the other along the common plane of symmetry, and on the other hand that at least the fraction 28 of the walls of the conduit 11 comprised between the two shafts 19 and 20 and at the level of the shutters 17 and 18 is flat and at right angles to the shafts 19 and 20, the portions of the shutters 17 and 18 located between the shafts 19 and 20 having a rectilinear profile.

Figure 5:
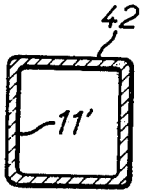
Figure 6:
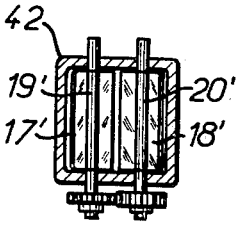

It should be noted that the shutters 17 and 18, instead of having a rounded contour at the exterior of the shafts 19 and 20 may in an alternative form be made rectangular and may be arranged in a conduit of rectangular section or of a section formed by a rectangle with rounded corners, as is described below and as shown more particularly in FIGS. 5 and 6.

There can be seen at 29 and 30 in FIG. 1, two slow-running jets which are respectively arranged in the vicinity of the two shutters 17 and 18 and which are supplied with fuel through a conduit 31.

The conduit 31 further comprises surfaces 32 distributed over the section of the conduit 11 and consisting, in the example shown in FIGS. 1 and 2, of a series of corrugated fins 32.

The fins 32 are provided at a sufficient temperature, for example 30° C. or higher, in order that the droplets of fuel become evaporated there fairly effectively, so that they do not become liable to form along the downstream edges of the fins 32, drops liable to be carried away with the gases.

The fins 32 are preferably surrounded by an annular jacket 33 adapted to receive a circulation of hot water from the engine, with an inlet at 34 and an outlet at 35. Instead of hot water, it would also be possible to provide a circulation of the exhaust gases. The circulation of the hot fluid in the annular jacket 33 has the effect of heating the fins 32 sufficiently to vaporize the carburetted mixture for the purpose of obtaining excellent homogeneity.

It will be noted from FIG. 1 that the surfaces constituted by the corrugated fins 32 are essentially arranged between the fuel-introduction device 13 and the butterfly throttle device 17, 18, that is to say on the upstream side of this latter.

The droplets of fuel coming from the jet 13 are completely dried-off on the heated fins 32, and are thus immediately and completely vaporized. It is thus already a vaporized carburetted mixture, and therefore more homogeneous, which is permitted to pass through the butterfly throttle valve, the construction of which with two balanced shutters 17 and 18, further improves the conditions for obtaining irreproachable homogeneity, not only on a micro-structural scale by reason of the vaporization of the carburetted mixture at 32, but also on a macro-structural scale due to the particular position of the fins 32 between the jet 13 and the butterfly valve 17, 18, and due to the construction of this latter with two shutters 17 and 18.

Reference will now be made to FIGS. 3 to 6, in which the arrangement is similar to that which has been described with reference to FIGS. 1 and 2, but the carburettor is in this case of the constant-depression type in which a conical needle 40 controls the admission of fuel into the conduit, indicated by 11' and this is effected in known manner in dependence on the depression existing in the said conduit 11' and acting on a piston 41. In a carburettor of this type, it is not necessary to provide slow-running jets such as the jets 29 and 30 of FIG. 1.

Figure 4:
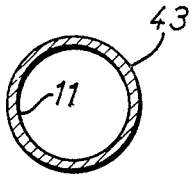
FIGS. 4, 5 and 6 are views in transverse section of this alternative form of carburettor, taken respectively along the line IV—IV, the line V—V and the line VI—VI of FIG. 3.

As previously, the butterfly throttle-valve comprises two shutters 17' and 18' mounted on the shafts 19' and 20', but these shutters 17' and 18' (see FIG. 6) have a rectangular section which is inscribed in a square section with rounded corners of the conduit 11', which has thus the square section in its downstream portion 42 (see FIG. 5) whereas an upstream portion at 43 is cylindrical (see FIG. 4). A transient section is provided at 44 in order to pass from 43 to 42.

As in the example shown in FIGS. 1 and 2, the surfaces 32' are essentially arranged between the jet device 40 and the butterfly throttle-device 17', 18', but in this case these surfaces 32' are constituted by a series of incurved fins of equal curvature, located level with an elbow 45 of the conduit.

It will be noted that at the level of this elbow 45, the section of the conduit 11' is already made square so as to facilitate the construction of the device with incurved fins 32'. There will be recognized at 33' the jacket which receives the heating fluid of the fins 32', either hot water from the engine or exhaust gases, and the inlet of which can be seen at 34' and the outlet at 35'.

Reference will now be made to FIG. 7 in which the arrangement is similar to that which has just been described with reference to FIGS. 3 to 6, and in which the carburettor is again of the constant-depression type with a needle jet device 40 responsive to the depression, and the surfaces indicated by 32'' are again arranged between the jet device 40 and the butterfly throttle-valve consisting of two shutters 17'' and 18'', but in this case the surfaces 32'' are constituted by a nest of tubes in staggered relation, traversed by a hot fluid such as hot water from the engine or exhaust gases.

It will be observed that the carburettor of FIG. 7 has no elbow, but the general direction of its conduit 11'' is inclined at 45°.

What I claim is:

1. A carburettor comprising a conduit, an air intake and throttle means disposed in respective upstream and downstream positions in said conduit in relation to the flow of air and fuel therein, fuel introduction means adapted to provide a uniform transverse distribution of fuel droplets in said conduit, said fuel introduction means including a conical needle controlling admission of fuel into the air flow through the air intake and mounted on a piston which is disposed transversely of the conduit and is acted upon by the depression in the conduit to admit more fuel when the depression is greater and less fuel when the depression is less, said conduit having a substantially constant cross section from said fuel introduction means to said throttle means, said conduit having an elbow therein between said fuel introduction means and said throttle means, all the air passing through said elbow in all positions of said throttle means, a plurality of regularly spaced parallel incurved heating fins disposed in said elbow between said fuel introduction means and said throttle means, the portions of the conduit upstream and downstream of said fins being disposed at a substantial angle to each other, and means to heat said fins.

* * * * *